US011103095B2

(12) United States Patent
Martinez

(10) Patent No.: US 11,103,095 B2
(45) Date of Patent: Aug. 31, 2021

(54) MODULAR TRAYS AND METHODS OF USING

(71) Applicant: Michael A. Martinez, Hobart, IN (US)

(72) Inventor: Michael A. Martinez, Hobart, IN (US)

( * ) Notice: Subject to any disclaimer, the term of this patent is extended or adjusted under 35 U.S.C. 154(b) by 0 days.

(21) Appl. No.: 17/081,583

(22) Filed: Oct. 27, 2020

(65) Prior Publication Data

US 2021/0120991 A1 Apr. 29, 2021

Related U.S. Application Data

(60) Provisional application No. 62/926,760, filed on Oct. 28, 2019, provisional application No. 63/027,670, filed on May 20, 2020.

(51) Int. Cl.
*A47C 7/70* (2006.01)
*A47G 23/06* (2006.01)

(52) U.S. Cl.
CPC ..... *A47G 23/0633* (2013.01); *A47G 23/0641* (2013.01)

(58) Field of Classification Search
CPC A47G 23/0633; A47G 23/0641; A47C 7/624; A47C 7/70; A47C 7/705; A47C 7/622; A47C 7/62; A47C 7/68
USPC ..... 220/575, 737, 751; 297/188.18, 144, 297/161, 188.14, 188.01
See application file for complete search history.

(56) References Cited

U.S. PATENT DOCUMENTS 4,575,149 A * 3/1986 Forestal ..... A47B 23/02 297/145
5,887,940 A * 3/1999 Anderson ..... A47C 7/70 297/135
5,893,331 A * 4/1999 Diletto ..... A47C 7/624 108/48
5,915,561 A 6/1999 Lorenzana et al.
6,109,580 A 8/2000 Stern et al.
6,264,026 B1 7/2001 Bradley
8,979,190 B2 * 3/2015 Madrigal ..... A47C 7/622 297/162
9,089,208 B2 * 7/2015 Zimmerman ..... A47B 23/02
10,201,232 B2 2/2019 Melaragno
10,786,073 B1 9/2020 Dillard
2002/0093228 A1 * 7/2002 Forston ..... A47C 7/62 297/188.14
2002/0117092 A1 8/2002 Zeiders
(Continued)

FOREIGN PATENT DOCUMENTS

CN 105852469 8/2016
JP 2019072094 5/2019

OTHER PUBLICATIONS

International Search Report for International Application No. PCT/US2020/057615, dated Feb. 18, 2021, (4 pgs).

*Primary Examiner* — James N Smalley
*Assistant Examiner* — Elizabeth J Volz
(74) *Attorney, Agent, or Firm* — Hartman Global IP Law; Gary M. Hartman; Domenica N. S. Hartman

(57) ABSTRACT

Modular tray and methods of using the modular tray to support various items by securing the modular tray to a structure in a cantilevered-type arrangement. The modular tray may include one or more of a junction member, a tray member, a cover member, a cylinder member, and a clamping unit. The modular tray can be secured to a structure with the clamping unit or the cylinder member so that one or more of the junction member, tray member, and cylinder member are cantilevered from the structure.

19 Claims, 10 Drawing Sheets

(56) References Cited

U.S. PATENT DOCUMENTS

| | | | | |
|---|---|---|---|---|
| 2005/0028707 | A1 | 2/2005 | Baggott | |
| 2015/0238034 | A1 | 8/2015 | Faulk | |
| 2017/0318974 | A1 | 11/2017 | Bergin | |
| 2017/0332791 | A1* | 11/2017 | Savovic | A47C 7/20 |
| 2019/0159600 | A1 | 5/2019 | Sartor | |
| 2020/0317107 | A1 | 10/2020 | Nowak | |

* cited by examiner

MODULAR TRAYS AND METHODS OF USING

CROSS-REFERENCE TO RELATED APPLICATIONS

This application claims the benefit of U.S. Provisional Application Nos. 62/926,760 filed Oct. 28, 2019, and 63/027,670 filed May 20, 2020, the contents of which are incorporated herein by reference.

BACKGROUND OF THE INVENTION

The present invention generally relates to trays adapted to support items, including but not limited to food, beverage containers, and/or non-food items. The invention particularly relates to a modular tray whose components can be selectively arranged and coupled to a variety of different structures to support food, beverage containers, and/or non-food items in various settings.

Food trays have been proposed that are mountable to furniture, including tables and chairs. While generally suitable for their intended purposes, such trays are often dedicated to attachment to particular structures having a particular configuration, such as an edge of a table, an arm of a chair, or the back of a chair in stadium, arena, and theater settings.

In view of the above, it can be appreciated that it would be desirable if a tray were available that was capable of being attached to various different structures so as to enable the tray to be used in a variety of different settings.

BRIEF SUMMARY OF THE INVENTION

The present invention provides a modular tray and methods of using the modular tray to support various items by securing the modular tray to a structure in a cantilevered-type arrangement.

According to one aspect of the invention, the modular tray may include one or more of a junction member, a tray member, a cover member, a cylinder member, and a clamping unit. The junction member has an opening, a recess on an upper side of the junction member, and a boss protruding from a lower side of the junction member. The tray member has an upper surface and a boss protruding from a lower side of the tray member. The boss of the tray member is complementary to the recess of the junction member. The cover member has an opening and a lower side. The opening of the cover member is complementary to the boss of the junction member. The cylinder member has a tubular shape and an opening at an upper end thereof surrounded by a wall. The cylinder member has portions that are complementary to the opening of the junction member, complementary to the opening of the cover member, and complementary to the boss of the tray member. The clamping unit includes upper and lower brackets that define a space therebetween and has means for securing the clamping unit to the structure placed within the space between the upper and lower brackets. The clamping unit also has means for securing the cover member to the clamping unit. The clamping unit is adapted to support the cover member on an upper side of the upper bracket that is adapted to bear against the lower side of the cover member.

Other aspects of the invention include particular assemblies and arrangements of the modular tray and methods of using the modular tray in combination with a structure using the clamping unit or the cylinder member for mounting the modular tray so that one or more of the junction member, tray member, and cylinder member are supported by and optionally cantilevered from the structure.

Other aspects and advantages of this invention will be appreciated from the following detailed description.

DETAILED DESCRIPTION OF THE INVENTION

Figure 1:
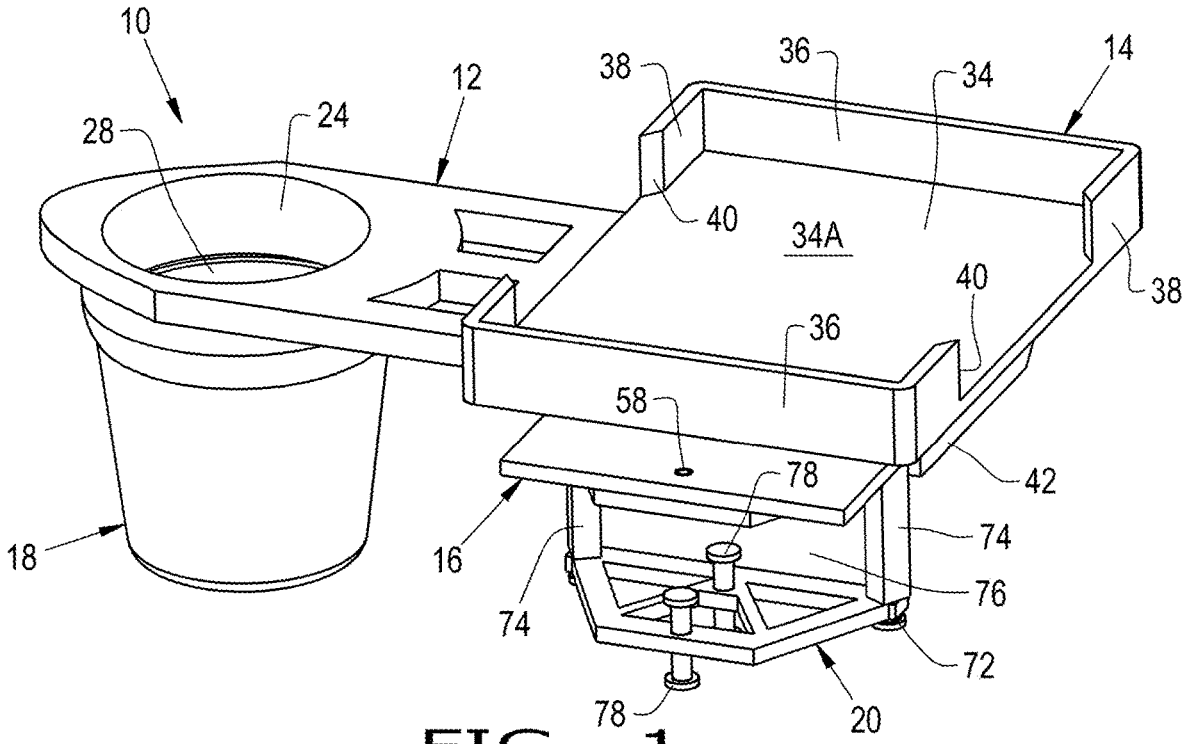
FIGS. 1, 2, and 3 schematically represent three configurations of a modular tray showing the tray with a clamping unit for mounting to an edge of a table (or similar structure) in accordance with nonlimiting embodiments of the invention.

The following disclosure describes various aspects of a nonlimiting embodiment of a modular tray 10 and components thereof that are schematically represented in FIGS. 1 through 13. The modular tray 10 is represented in different configurations for use in different settings and capable of utilizing different structures from which the modular tray 10 can be supported. While the modular tray 10 will be described in reference to such structures as tables and chairs that may be of conventional forms, the modular tray 10 described herein can be used with a wide variety of structures other than what is described or shown in reference to the drawings.

To facilitate the description provided below of the embodiments represented in the drawings, relative terms, including but not limited to, "proximal," "distal," "vertical," "horizontal," "lateral," "front," "rear," "side," "forward," "rearward," "top," "bottom," "upper," "lower," "above," "below," "right," "left," etc., may be used in reference to an orientation of the modular tray 10 during its use while mounted to a structure. All such relative terms are intended to indicate the construction and relative orientations of components and features of the modular tray 10 and therefore are relative terms that are useful to describe the illustrated embodiments and indicate the construction, installation and use of the modular tray 10, and in doing so may help to define the scope of the invention.

Figure 2:
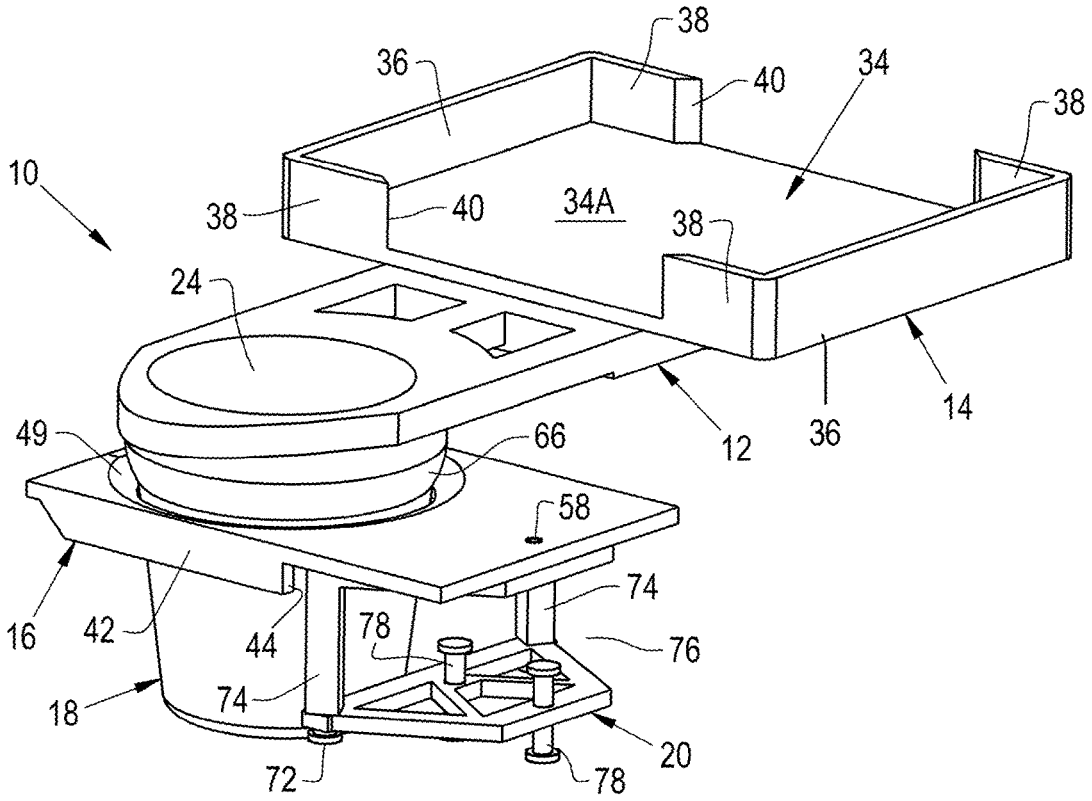
Figure 3:
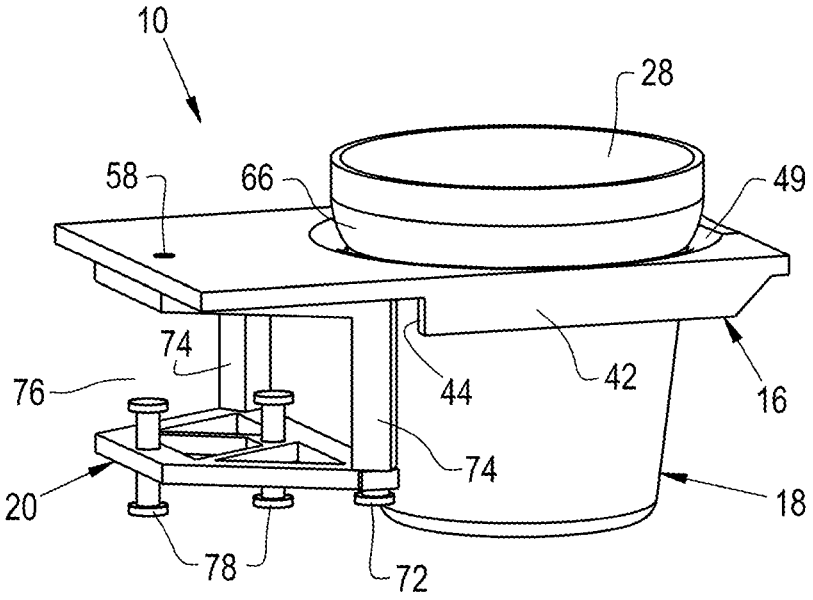
Figure 4:
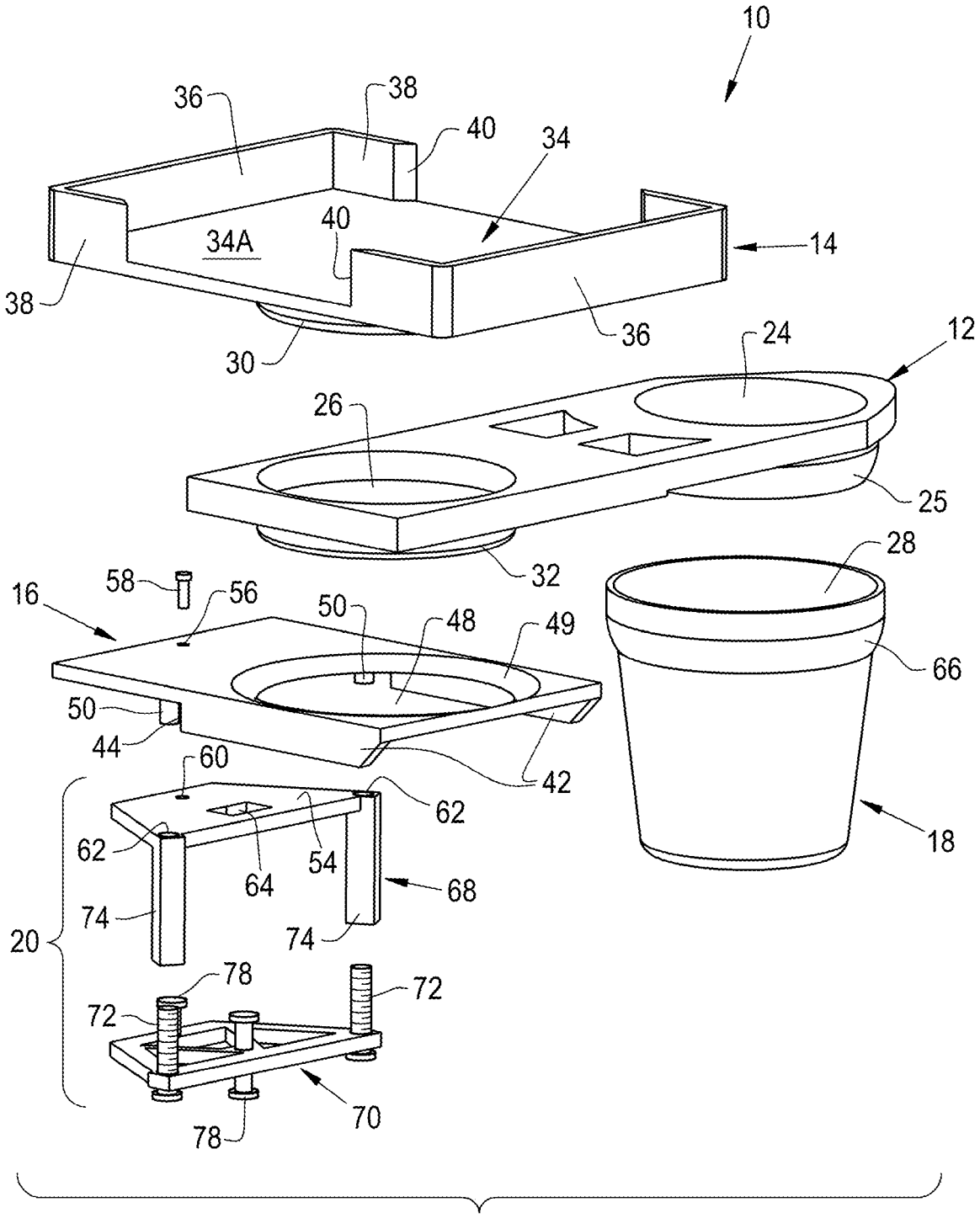
FIGS. 4, 5, and 6 schematically represent exploded views of the three configurations of the modular tray shown in FIGS. 1, 2, and 3, respectively.
Figure 5:
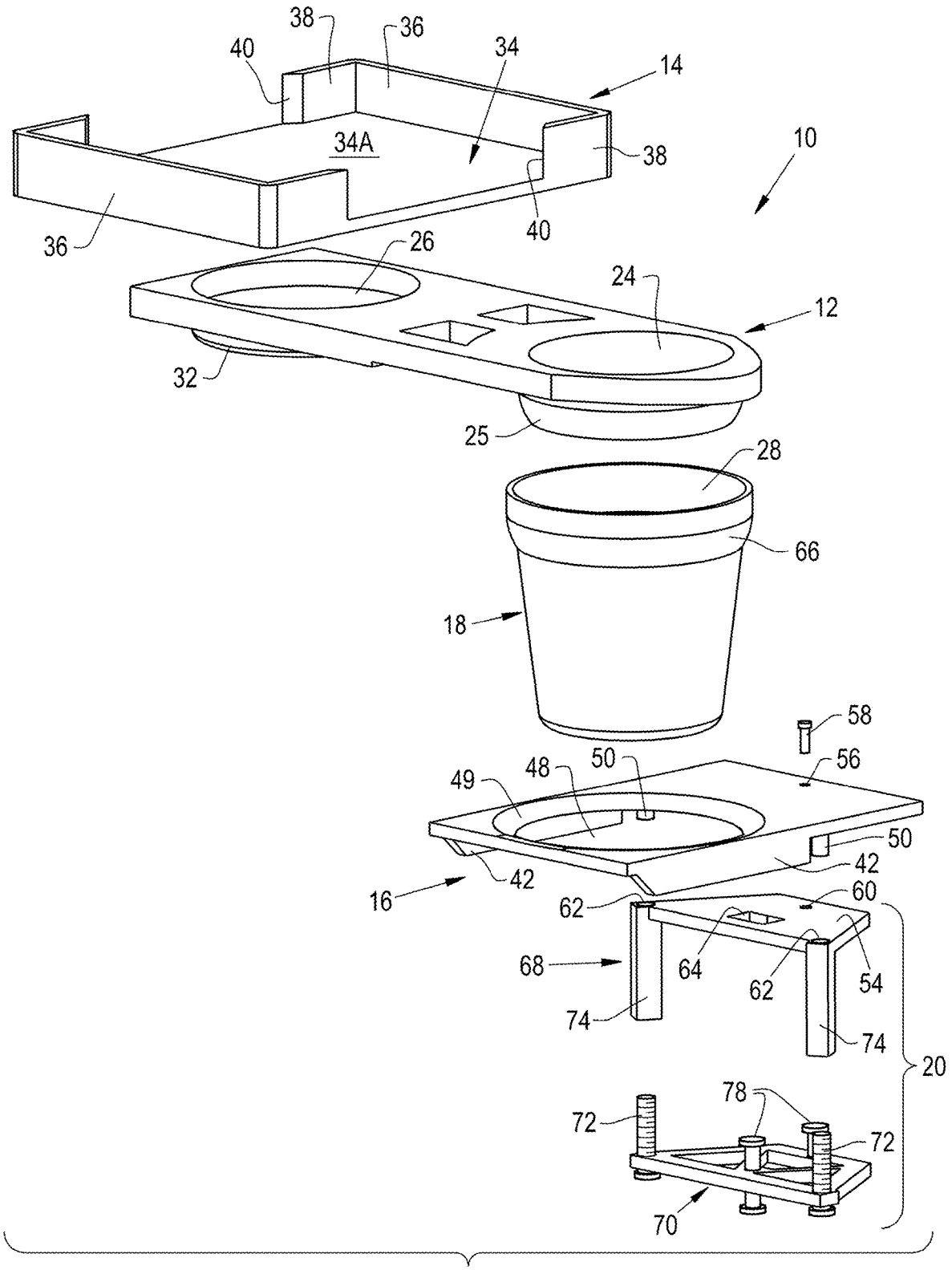
Figure 6:
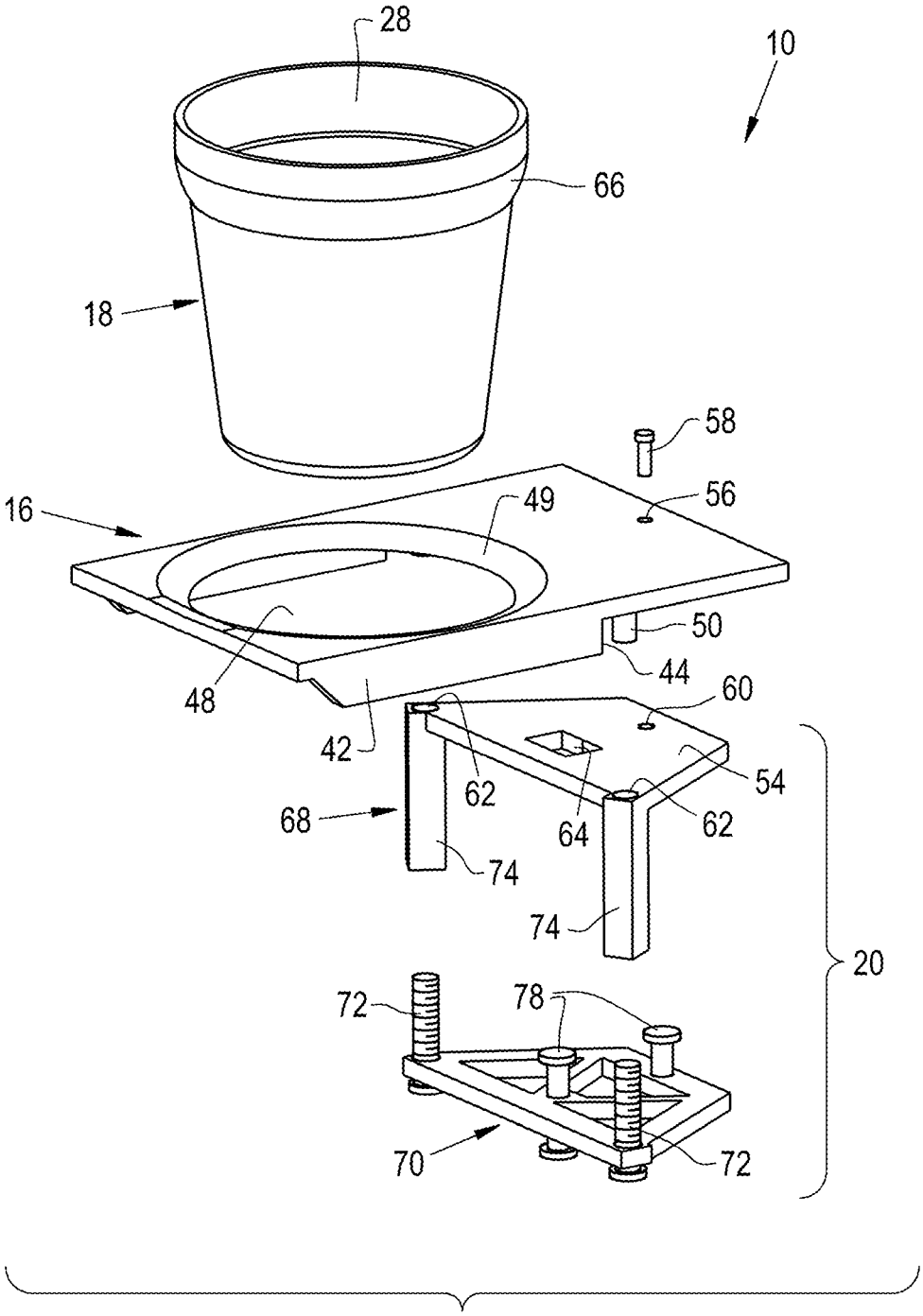

FIGS. 1, 2, and 3 schematically represent first, second, and third configurations, respectively, of the modular tray 10 showing the tray 10 configured for mounting to an edge of a structure, for example, a table or similar structure, in accordance with nonlimiting embodiments of the invention, and FIGS. 4, 5, and 6 schematically represent exploded views of the modular tray 10 as configured in FIGS. 1, 2, and 3, respectively. In the configurations shown in FIGS. 1, 2, 4, and 5, the modular tray 10 is represented as comprising a junction member 12, a tray member 14, a cover member 16, a cylinder member 18, and a clamping unit 20. In the configuration shown in FIGS. 3 and 6, the modular tray 10 is represented as utilizing the same the cover member 16, cylinder member 18, and clamping unit 20, but omitting the junction member 12 and tray member 14.

Figure 7:
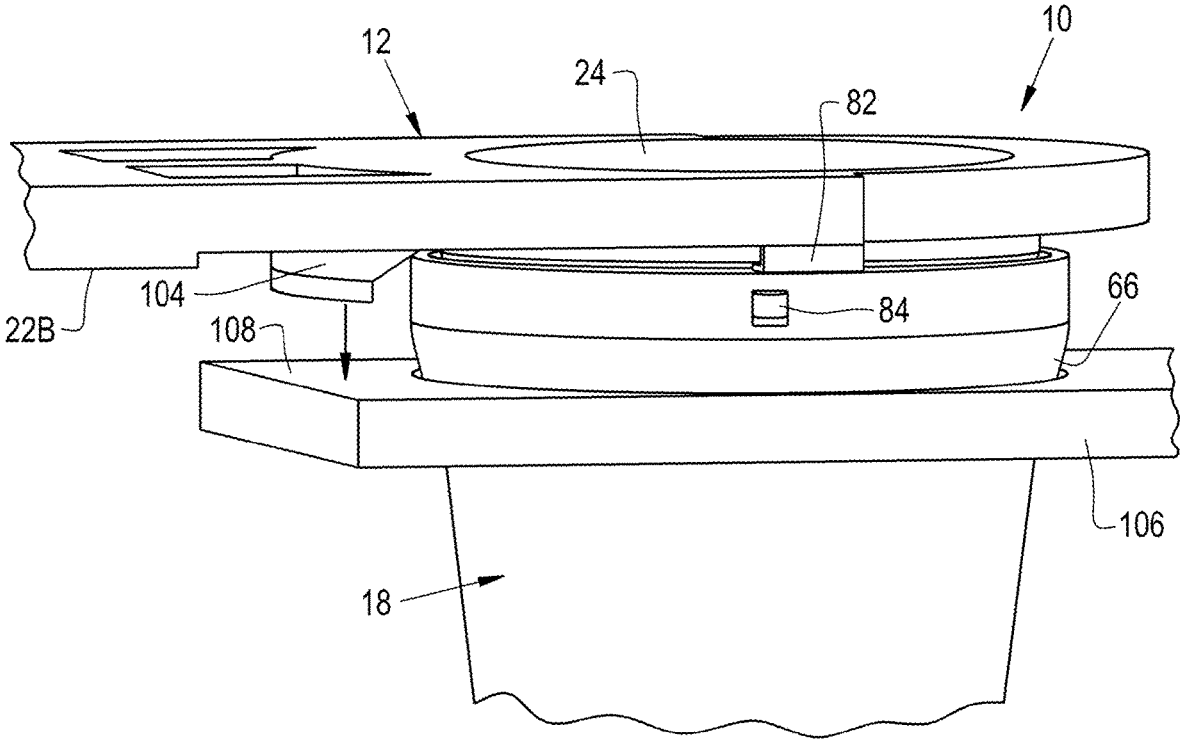
FIGS. 7 and 8 schematically represent fourth and fifth configurations of the modular tray of FIGS. 1 through 6 showing the modular tray without a clamping unit and instead configured for mounting to a cup holder in an armrest of a chair (or similar structure) in accordance with additional nonlimiting embodiments of the invention.
Figure 9A:
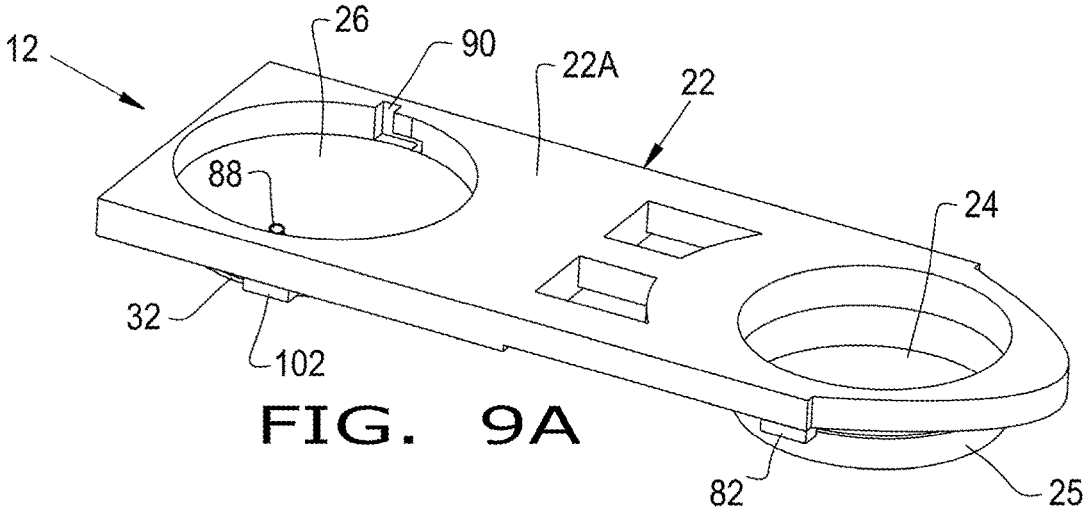
FIGS. 9A through 9C schematically represent different views of a junction member used in the configurations of the modular tray represented in FIGS. 1, 2, 4, 5, and 7.
Figure 9B:
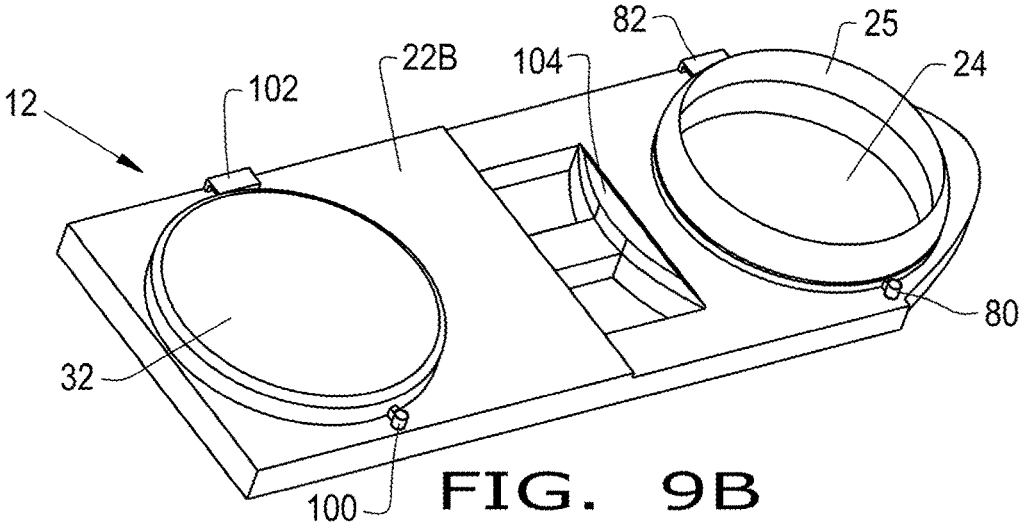
Figure 9C:
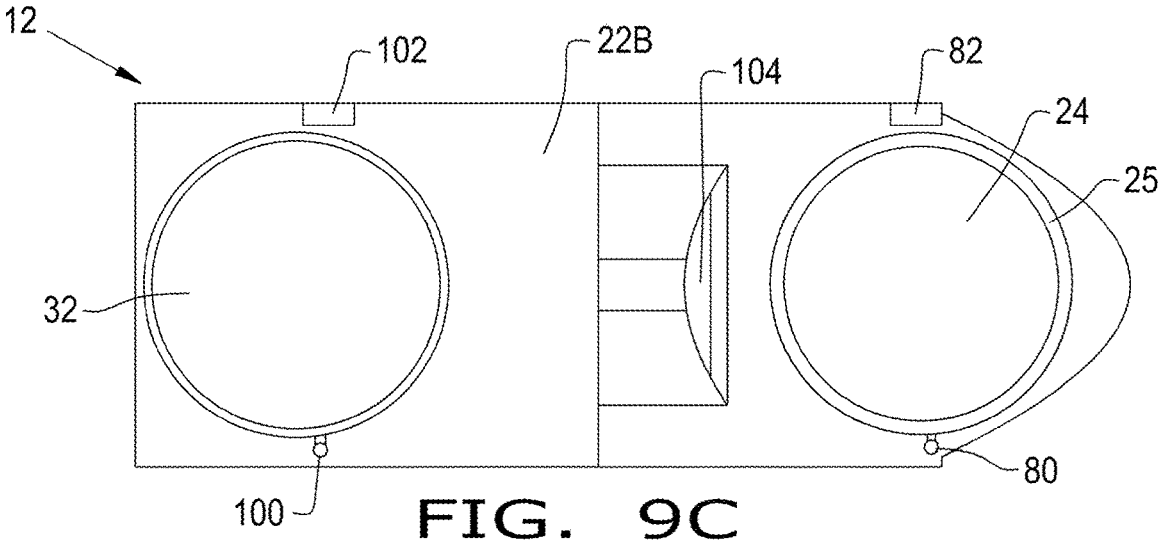

As perhaps more readily seen in the isolated views of the junction member 12 in FIGS. 9A through 9B, the junction member 12 generally has a planar shape that defines a panel 22 that can have a shape, length, width, and thickness other than what is shown in the drawings. The panel 22 is shown as having an opening 24 and a recess 26 adjacent oppositely disposed ends of the junction member 12. The opening 24 is surrounded by a tapered rim 25 and is sized and shaped to be complementary to an opening 28 in the cylinder member 18 as seen in FIGS. 1, 2, and 7, and the recess 26 is formed in the upper surface (or side) 22A of the panel 22 and is sized and shaped to receive a complementary feature (referred to herein as a boss) 30 protruding from a lower surface (or side) 34B of the tray member 14 (FIGS. 10B and 10C). Opposite the recess 26, the junction member 12 has a feature (referred to herein as a boss) 32 that protrudes from its lower surface (or side) 22B (FIGS. 9B and 9C). As discussed below, the boss 32 is sized and shaped to be received in a complementary opening 48 in the cover member 16 as evident from FIG. 4. Though the bosses 30 and 32 and their respective complementary recess 26 and opening 48 are represented as having circular perimeters, other peripheral shapes are foreseeable.

Figure 10A:
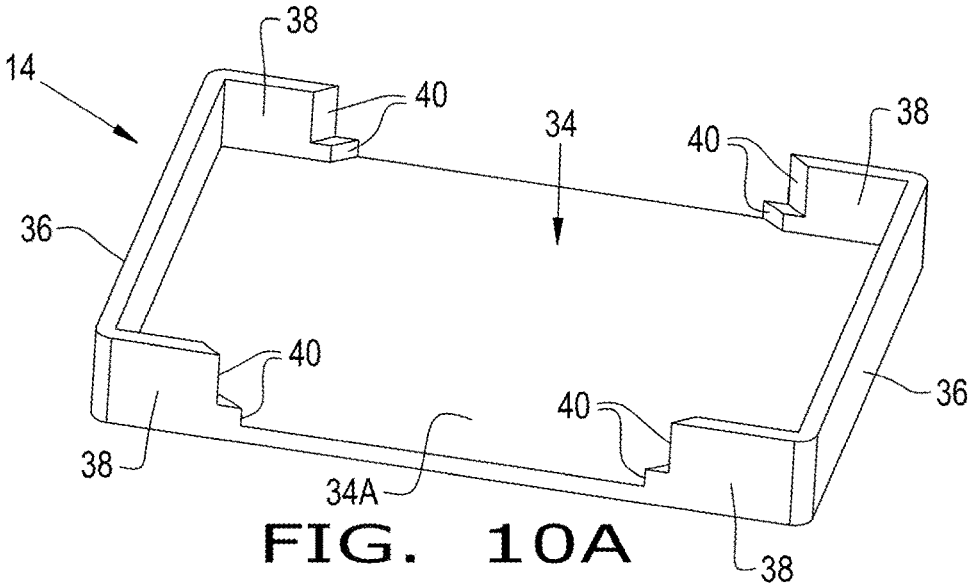
FIGS. 10A through 10C schematically represent different views of a tray member used in the configurations of the modular tray represented in FIGS. 1, 2, 4, 5, and 8.
Figure 10B:
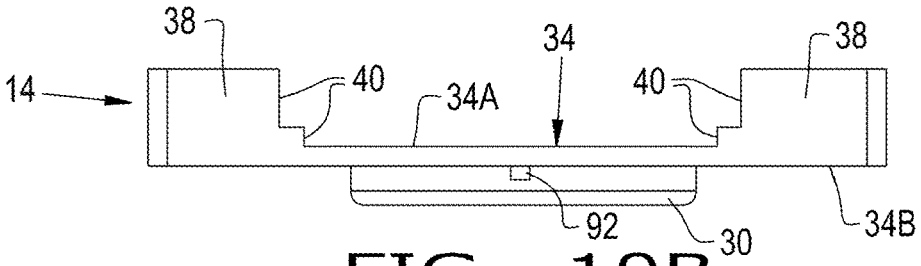
Figure 10C:
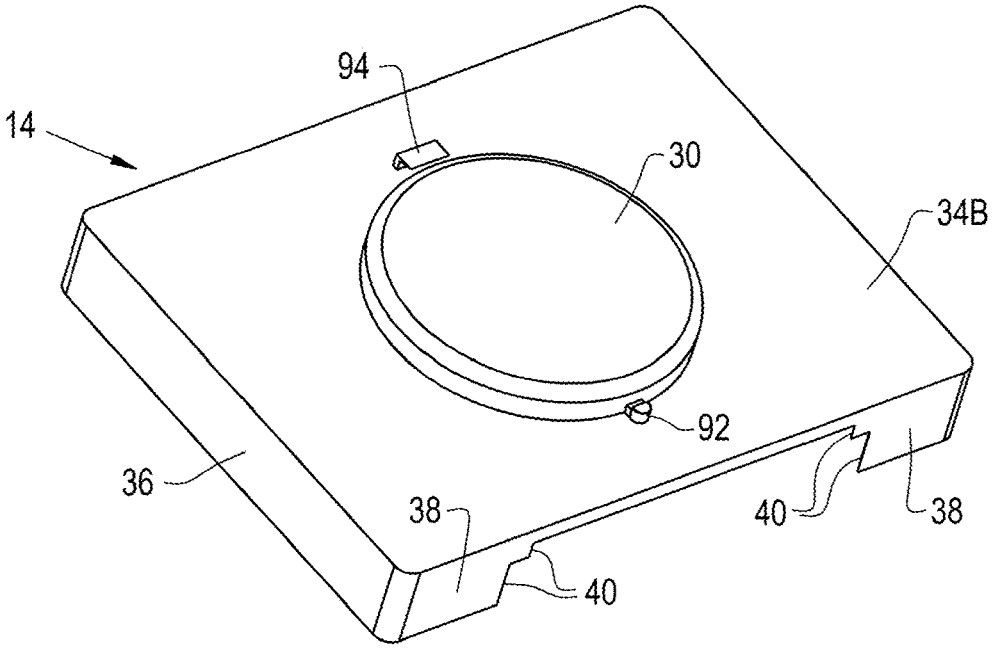

The tray member 14 is shown in isolation in FIGS. 10A, 10B, and 10C, and can be seen to generally have a base 34 whose shape, length, width, and thickness can be other than what is shown in the drawings. End walls 36 and side walls 38 at least partially surround the base 34 at its perimeter, and the side walls 38 each have at least one notch formed therein that enable the upper surface (or side) 34A of the tray member 14 to accommodate, confine, and stabilize articles on the tray 14, for examples, two different sizes of plates with diameters that are less than the length of the base 34 (between the end walls 36) but larger than the width of the base 34 (between the side walls 38). As previously noted, the boss 30 protruding from the lower surface 34B of the tray member 14 (FIGS. 10B and 10C) is sized and shaped to be complementary to the recess 26 formed in the upper surface 22A of the junction member 12. Additionally, the boss 30 is preferably sized and shaped to be complementary to the opening 18 of the cylinder member 18 to enable direct coupling of the tray and cylinder members 14 and 18 (discussed in reference to FIG. 8 below).

Figure 11A:
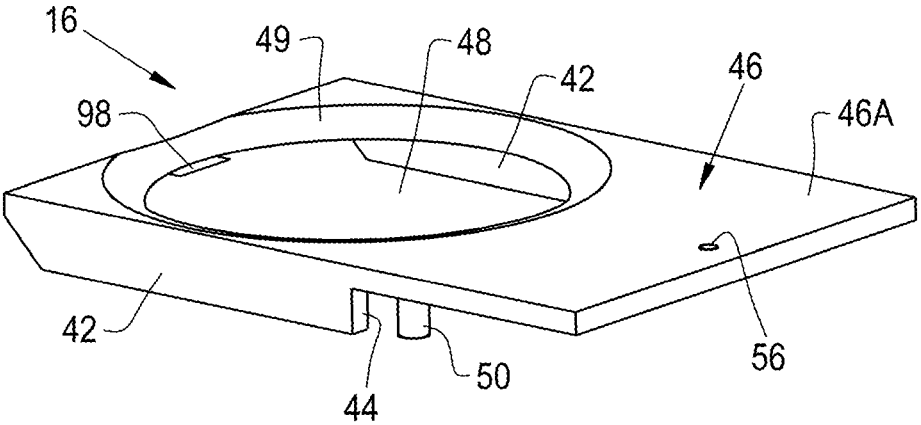
FIGS. 11A and 11B schematically represent different views of a cover member used in the configurations of the modular tray represented in FIGS. 1 through 6.
Figure 11B:
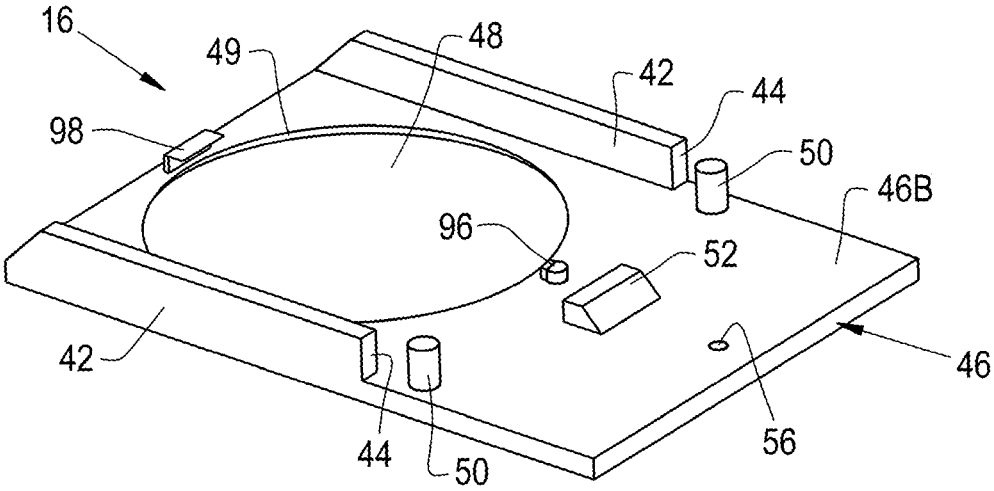
Figure 13:
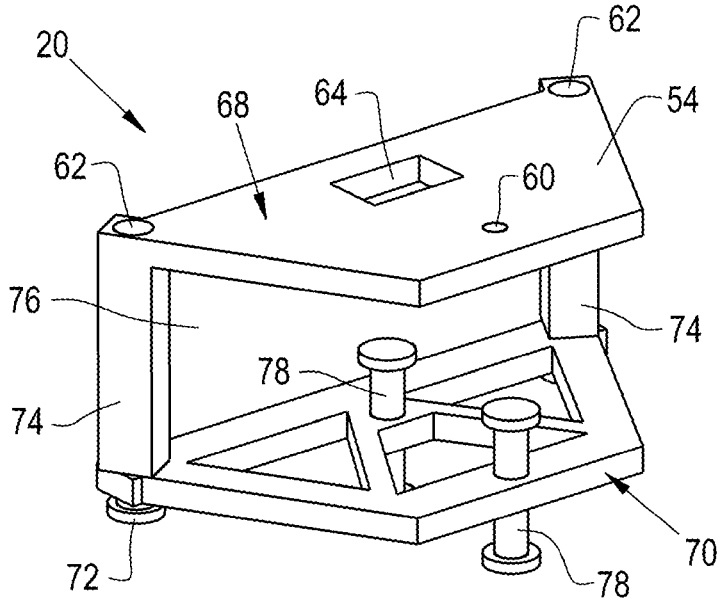
FIG. 13 schematically represents a clamping unit used in the configurations of the modular tray represented in FIGS. 1 through 6.

The cover member 16 is shown in isolation in FIGS. 11A and 11B, and can be seen to generally have a planar shape that defines a panel 46 whose shape, length, width, and thickness can be other than what is shown in the drawings. In addition to the aforementioned opening 8, the panel 46 is shown as having rails 42 adjacent one end of the cover member 16 and multiple protrusions 50 and 52 adjacent an opposite end of the cover member 16. The opening 48 is surrounded by a tapered rim 49 and, in addition to being complementarily sized and shaped to receive the boss 30 protruding from the lower surface 34B of the tray member 14 (FIGS. 1 and 4), the opening 48 is also complementarily sized and shaped to receive the cylinder member 18 (FIGS. 2, 3, 5, and 6). The rails 42 and protrusions 50 and 52 protrude from a lower surface (or side) 46B of the panel 46 and are spaced apart in both lateral and longitudinal directions of the cover member 16 to provide stable contacts for surface-to-surface engagement with structures that the cover member 16 may contact. As nonlimiting examples, side edges 44 formed by the rails 42 are particularly suitable for engaging an edge of a table or chair to which the modular tray 10 is mounted with the clamping unit 20, and the protrusions 50 and 52 are particularly suitable for surface-to-surface engagement with on an upper surface (or side) 54 of the clamping unit 20, as will be discussed in more detail below. The cover member 16 further includes means for releasably securing the cover member 16 to the clamping unit 20. In the nonlimiting embodiment shown, this securing means comprises at least one hole 56 through which a fastener 58 (FIGS. 4, 5, and 6) is able to pass and engage a complementary hole 60 provided in the clamping unit 20. Though the fastener 58 is an example of a suitable securing means that can be easily installed to secure the cover member 16 to the clamping unit 20, other securing means are foreseeable, for example, threaded fasteners, clamps, ratchets, etc. As seen in FIG. 13, the clamping unit 20 further includes recesses 62 and 64 that are complementary to the protrusions 50 and 52 of the cover member 20, more particularly hereinafter referred to as posts 50 sized, shaped, and located on the cover member 16 to be received in the pair of recesses 62 of the clamping unit 20 and a bar 52 sized, shaped, and located on the cover member 16 to be received in the recess 64 of the clamping unit 20. As evident from FIGS. 11A, 11B, and 13, the holes 56 and 60 of the cover member 16 and clamping unit 20, respectively, are longitudinally spaced from their respective complementary posts 50, bar 52, and recesses 62 and 64 to promote the stability of the cover member 16 relative to the clamping unit 20 when secured to the clamping unit 20 with the fastener 58. Though the complementary protrusions 50 and 52 and recesses 62 and 64 are disclosed and shown, other means for coupling the cover member 16 and clamping unit 20 are foreseeable, including threaded fasteners, clamps, ratchets, etc. Furthermore, it is foreseeable that the recesses 62 and 64 could be formed in the lower surface 46B of the cover member 16, and the protrusions 50 and 52 could be formed in the clamping unit 20. Once secured together, the cover member 16 and clamping unit 20 can be handled and treated as an assembly that can be directly coupled to the junction member 12 (FIG. 1) by securing the boss 32 protruding from the lower surface 22B of the junction member 12 within the opening 48 of the cover member 16, or directly coupled to the cylinder member 18 (FIGS. 2 and 3) by placing the cylinder member 18 within the opening 48 of the cover member 16 so that a tapered outer wall 66 of the cylinder member 18 engages the rim 49 surrounding the opening 48.

Figure 12:
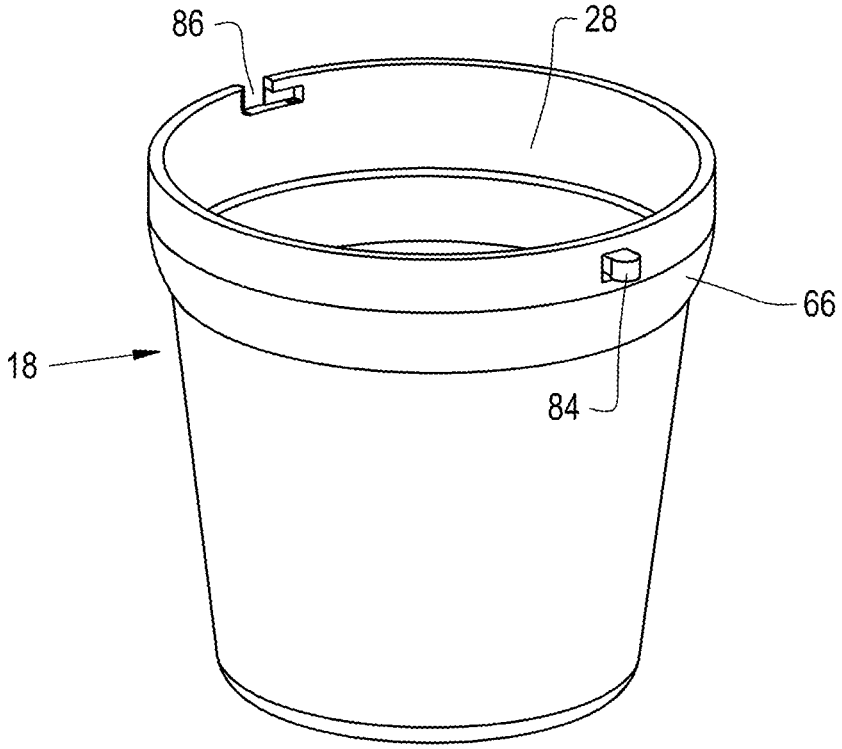
FIG. 12 schematically represents a cylinder member used in the configurations of the modular tray represented in FIGS. 1 through 8.

The cylinder member 18 is shown in isolation in FIG. 12 and its outer shape can be seen to generally be defined by the tapered wall 66. The cylinder member 18 has a tubular shape whose shape, length, diameter, and wall thickness can be other than what is shown in the drawings. The opening 28 of the cylinder member 18 provides an entry to an interior cavity that is preferably sized to receive and accommodate a beverage container, for example, a cup, can, or bottle. The lower end (not visible) of the cylinder member 18 may be optionally closed, partially open, or completely open. The tubular shape of the cylinder member 18 is tapered in a manner so that its diameter (or width) at its opening 28 is greater than its diameter (or width) at its lower extremity.

The clamping unit 20 shown the drawings can be seen to be an assembly that comprises an upper bracket 68 and a lower bracket 70 that are secured together with fasteners 72. In the nonlimiting embodiment shown, the upper bracket 68 includes columns 74 that space the brackets 68 and 70 apart and are each individually axially aligned with a corresponding one of the pair of recesses 62 of the upper bracket 68. Furthermore, the columns 74 each have a threaded bore (not shown) into which the fasteners 72 are threaded into after passing through the lower bracket 70. The fasteners 72 and columns 74 are represented as rigidly connecting the upper and lower brackets 68 and 70 together so that portions of each bracket 68 and 70 are cantilevered in parallel from the columns 74, creating a space 76 between the brackets 68 and 70 that is capable of receiving an edge of a structure, as a nonlimiting example, the edge of a table, armrest of a chair or wheelchair, etc. The clamping unit 20 includes means for securing the clamping unit 20 to a structure placed within the space 76 between the brackets 68 and 70. As a nonlimiting example, the clamping means is represented by at least one and preferably two or more threaded posts 78 that threadably pass through the lower bracket 70 in a direction toward the upper bracket 68 so that the threaded posts 78 are able to apply a clamping load to a structure between the threaded posts 78 and the upper bracket 68. The threaded posts 78 are represented as being midway between the columns 74 and aligned with the cantilevered direction of the upper and lower brackets 68 and 70. Though the threaded posts 78 are examples of suitable clamping means that are easy to operate to apply a clamping load, other clamping means are foreseeable, for example, spring-biased plates or pins, ratchets, etc.

Each of the configurations for the modular tray 10 represented in FIGS. 1 through 6 is represented as being adapted to mount to an edge of a table, armrest of a chair or wheelchair, or any other structure capable of being received within the opening 76 of the clamping unit 20. In FIGS. 1 and 2, clamping a structure within the space 76 and between the upper and lower brackets 68 and 70 of the clamping unit 20 results in the junction member 12, tray member 14, and cylinder member 18 are all cantilevered from the structure. The configurations of FIGS. 1 and 2 differ in that the tray member 14 and cylinder member 18 are, respectively, proximate and distal to the clamping unit 20 and structure in FIG. 1, but the tray member 14 and cylinder member 18 are, respectively, distal and proximate to the clamping unit 20 and structure in FIG. 2. In either case, a user is able to use the modular tray 10 to place a beverage container within the interior of the cylinder member 18 and support food and/or non-food items on the tray member 14. The configuration of the modular tray 10 of FIG. 3 lacks the junction and tray members 12 and 14, such that only the cylinder member 18 is cantilevered from the structure with the clamping unit 20.

Figure 8:
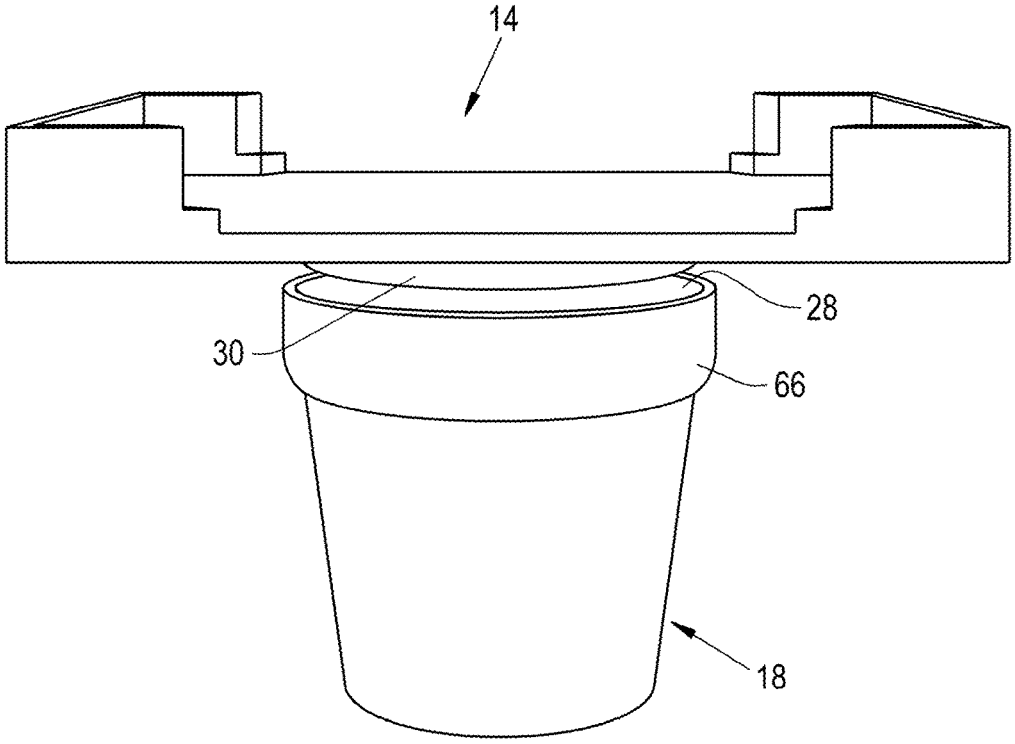

FIGS. 7 and 8 illustrate the additional versatility of the modular tray 10 to be mounted to a structure with the cylinder member 18, for example, by inserting the cylinder member 18 into a cup holder of a type conventionally provided in armrests of stadium, arena, and theater chairs. The configurations of the modular tray 10 represented in FIGS. 7 and 8 do not require or utilize the cover member 16 or clamping unit 20. Instead, and as shown in FIG. 7, the modular tray 10 can utilize the cylinder member 18 to directly secure the modular tray 10 to an armrest 106 by inserting the cylinder member 18 into the opening of a cup holder formed in the armrest 106 so that the tapered exterior of the wall 66 of the cylinder member 18 frictionally engages the interior wall of the cup holder. FIG. 7 further depicts a rest bar 104 protruding from the lower surface 22B of the junction member 12 between its opening 24 and boss 32 so that the rest bar 104 is able to contact and bear against an upper surface 108 of the armrest 106 to help support and stabilize the modular tray 10 relative to the armrest 106. As evident from FIG. 7, inserting the cylinder member 18 in the cup holder of the armrest 106 results in at least the junction member 12 being cantilevered from the armrest 106 with the cylinder member 18. Optionally the tray member 14 can be coupled to the junction member 12 with their respective boss 30 and recess 26 so that the tray member 14 is also cantilevered from the armrest 106 with the cylinder member 18. As such, a user is able to use the modular tray 10 to place a beverage container within the interior of the cylinder member 18 and support food and/or non-food items on the tray member 14. As evident from FIG. 8, as a result of inserting the cylinder member 18 in a cup holder of an armrest (e.g., the armrest 106 of FIG. 7), the tray member 14 can be centrally disposed above the armrest with the cylinder member 18 instead of being cantilevered from the armrest. As such, a user is able to use the modular tray 10 to support relatively heavy items on the tray member 14.

As described above, the opening 24 in the junction member 12 is sized and shaped to be complementary to the opening 28 in the cylinder member 18 (FIGS. 1, 2, and 7), and the opening 28 of the cylinder member 18 and the recess 26 in the upper surface 22A of the junction member 12 are sized and shaped to receive the boss 30 protruding from the lower surface 34B of the tray member 14 (FIGS. 1, 2, 4, 5, and 8). Additionally, the opening 48 of the cover member 16 is sized and shaped to be able to selectively receive either the boss 32 protruding from the lower surface 22B of the junction member 12 (FIGS. 1 and 4) or the cylinder member 18 (FIGS. 2, 3, 5, and 6). The rims 25 and 49 surrounding the openings 24 and 48 of the junction member 12 and cover member 16 are tapered to promote stability of their coupling with the bosses 30 and 32 of the tray member 14 and junction member 12 and with the opening 28 and tapered wall 66 of the cylinder member 18.

To enable these complementary pairs to remain secured together, each of the openings 24 and 28, recess 26, bosses 30 and 32, and cylinder member 18 can be equipped with interlocking features. In the nonlimiting embodiment represented in the drawings, the interlocking features are depicted as male and female features located at or near a perimeter of each opening 24 and 28, recess 26, boss 30 and 32, and cylinder member 18. In particular, male and female features 80 and 82 (FIGS. 9A, 9B, and 9C) are located adjacent the rim 25 that surrounds the opening 24 of the junction member 12 that interlock with, respectively, a complementary female feature 86 and a complementary male feature 84 formed at a rim 29 surrounding the opening 28 of the cylinder member 18 (FIG. 12) to securely couple the junction and cylinder members 12 and 18 as shown in FIGS. 1, 2, 4, 5, and 7. Male and female features 88 and 90 are formed on an interior side wall of the recess 26 of the junction member 12 (FIG. 9A) and interlock with, respectively, a complementary female feature 94 and a complementary male feature 92 at the exterior of the boss 30 of the tray member 14 (FIGS. 10B and 10C) to securely couple the junction and tray members 12 and 14 as shown in FIGS. 1, 2, 4, and 5. The male and female features 84 and 86 formed at the rim 29 of the cylinder member 18 (FIG. 12) are also configured to interlock with, respectively, the female and male features 94 and 92 at the exterior of the boss 30 of the tray member 14 (FIGS. 10B and 10C) to securely couple the tray and cylinder members 14 and 18 as shown in FIG. 8. Male and female features 96 and 98 (FIGS. 11A and 11B) are located adjacent the rim 49 that surrounds the opening 48 of the cover member 16 and interlock with, respectively, a complementary female feature 102 and a complementary male feature 100 at the exterior of the boss 32 of the junction member 12 (FIGS. 9B and 9C) as well as, respectively, the female and male features 86 and 84 at the rim 29 of the opening 28 of the cylinder member 18 (FIG. 12) to securely couple the cover and junction members 16 and 14 as shown in FIGS. 1 and 4 and to securely couple the cover and cylinder members 16 and 18 as shown in FIGS. 2, 3, 5, and 6. As represented, the complementary pairs of male and female features 80-102 are configured to interlock with each other using a twisting motion, though other interlocking configurations and motions are foreseeable.

While the invention has been described in terms of particular embodiments, it should be apparent that alternatives could be adopted by one skilled in the art. For example, the modular tray 10 and its components could differ in appearance from the embodiments described herein and shown in the drawings, and functions of certain components of the modular tray 10 could be performed by components of different construction but capable of a similar (though not necessarily equivalent) function. As such, it should be understood that the intent of the above detailed description is to describe the particular embodiments represented in the drawings and certain but not necessarily all features and aspects thereof, and to identify certain but not necessarily all alternatives to the particular embodiments represented in the drawings. As a nonlimiting example, the invention encompasses additional or alternative embodiments in which one or more features or aspects of a particular embodiment could be eliminated or two or more features or aspects of different described embodiments could be combined. Accordingly, it should be understood that the invention is not necessarily limited to any particular embodiment represented in the drawings or described herein, and that the purpose of the above detailed description and the phraseology and terminology employed therein is to describe those particular embodiments represented in the drawings, and not necessarily to serve as limitations to the scope of the invention. Therefore, the scope of the invention is to be limited only by the following claims.

The invention claimed is:

1. A modular tray adapted to be mounted to a structure, the modular tray comprising:

a junction member having an opening, a recess on an upper side of the junction member, and a boss protruding from a lower side of the junction member;

a tray member having an upper surface and having a boss protruding from a lower side of the tray member, the boss of the tray member being complementary to the recess of the junction member;

a cover member having an opening and a lower side, the opening of the cover member being complementary to the boss of the junction member;

a cylinder member having a tubular shape and an opening at an upper end thereof surrounded by a wall, the cylinder member having portions that are complementary to the opening of the junction member, complementary to the opening of the cover member, and complementary to the boss of the tray member; and a clamping unit comprising upper and lower brackets that define a space therebetween and means for securing the clamping unit to the structure placed within the space between the upper and lower brackets, the clamping unit having means for securing the cover member to the clamping unit, the clamping unit being adapted to support the cover member on an upper side of the upper bracket that is adapted to bear against the lower side of the cover member.

2. The modular tray of claim 1, wherein the opening of the junction member is located at one end of the junction member and the recess of the junction member is located at an oppositely-disposed second end of the junction member.

3. The modular tray of claim 1, further comprising a rest bar protruding from the lower side of the junction member between the opening and the boss thereof so that the rest bar is able to contact and bear against an upper surface of the structure.

4. The modular tray of claim 1, wherein the cover member has protrusions that protrude from the lower side thereof, and the clamping unit has features in the upper side of the upper bracket that are adapted to bear against the protrusions of the cover member.

5. The modular tray of claim 4, wherein the protrusions are spaced apart in both lateral and longitudinal directions of the cover member.

6. The modular tray of claim 4, wherein the protrusions comprise at least a pair of posts and a bar between the pair of posts, the features in the upper side of the upper bracket comprise recesses, the pair of posts are sized, shaped, and located on the cover member to be received in a pair of the recesses and the bar is sized, shaped, and located on the cover member to be received in another of the recesses.

7. The modular tray of claim 4, wherein the clamping unit comprises columns that space the upper and lower brackets apart and are each individually axially aligned with a corresponding one of the features of the upper bracket.

8. The modular tray of claim 1, further comprising at least a pair of rails protruding from the lower side of the cover member so that the opening of the cover member is between the pair of rails.

9. The modular tray of claim 1, further comprising complementary pairs of male and female features adapted to interlock the boss of the tray member with the recess of the junction member and with the opening of the cylinder member, adapted to interlock the boss of the junction member with the opening of the cover member, and adapted to interlock the opening of the cylinder member with the opening of the junction member and with the opening of the cover member.

10. The modular tray of claim 1, wherein the modular tray is assembled and arranged so that:

the boss of the tray member is in the recess of the junction member and couples the tray member to the junction member;

the boss of the junction member is in the opening of the cover member and couples the junction member to the cover member;

the cylinder member is coupled to the opening of the junction member; and the cover member is secured to the clamping unit with the securing means.

11. The modular tray of claim 10, wherein the tray member and the cylinder member are, respectively, proximate and distal to the clamping unit and the structure.

12. The modular tray of claim 10, wherein the tray member and the cylinder member are, respectively, distal and proximate to the clamping unit and the structure.

13. A method of using the modular tray of claim 10, the method comprising clamping the structure within the space and between the upper and lower brackets of the clamping unit so that the junction member, the tray member, and the cylinder member are all cantilevered from the structure.

14. The modular tray of claim 1, wherein the modular tray is assembled and arranged so that:

the cylinder member is in the opening of the cover member; and the cover member is secured to the clamping unit with the securing means.

15. A method of using the modular tray of claim 14, the method comprising clamping the structure within the space and between the upper and lower brackets of the clamping unit so that only the cylinder member is cantilevered from the structure with the clamping unit.

16. The modular tray of claim 1, wherein the modular tray is assembled and arranged so that the cylinder member is in the opening of the junction member.

17. A method of using the modular tray of claim 16, the method comprising inserting the cylinder member in an opening of the structure so that at least the junction member is cantilevered from the structure through the cylinder member.

18. The modular tray of claim 1, wherein the modular tray is assembled and arranged so that the boss of the tray member is in the opening of the cylinder member and couples the tray member to the cylinder member.

19. A method of using the modular tray of claim 18, the method comprising inserting the cylinder member in an opening of the structure so that at least the tray member is supported by the structure through the cylinder member.

* * * * *